US005752277A

United States Patent [19]

van der Sleesen

[11] Patent Number: 5,752,277

[45] Date of Patent: May 19, 1998

[54] GARMENT WITH STRUCTURAL VENT

[75] Inventor: Michael F. van der Sleesen, West Hartford, Conn.

[73] Assignee: Vanson Leathers, Inc., Stoughton, Mass.

[21] Appl. No.: 718,222

[22] Filed: Sep. 20, 1996

Related U.S. Application Data

[63] Continuation of Ser. No. 349,269, Dec. 5, 1994, abandoned which is a continuation-in-part of PCT/US94/04121, Apr. 14, 1994.

[51] Int. Cl.[6] ..... A41D 1/02

[52] U.S. Cl. ..... 2/69; 2/108

[58] Field of Search ..... 2/69, 69.5, 85, 2/93, 94, 108, 87, DIG. 1, 79, 102, 115

[56] References Cited

U.S. PATENT DOCUMENTS

| | | |
|---|---|---|
| 308,244 | 11/1884 | Fishel . |
| 1,015,231 | 1/1912 | Jacobs . |
| 1,360,390 | 11/1920 | Gilfillan . |
| 2,010,434 | 8/1935 | Langrock . |
| 2,073,711 | 3/1937 | Robinsohn . |
| 2,079,980 | 5/1937 | Anders . |
| 2,084,173 | 6/1937 | Wexler . |
| 2,114,514 | 4/1938 | York . |
| 2,259,560 | 10/1941 | Glidden . |
| 2,700,769 | 2/1955 | Polchinski . |
| 2,713,168 | 7/1955 | Bagnato . |
| 2,715,226 | 8/1955 | Weiner . |
| 2,989,754 | 6/1961 | Bukspan . |
| 3,045,243 | 7/1962 | Lash et al. . |
| 3,086,215 | 4/1963 | Di Paola . |
| 3,153,793 | 10/1964 | Lepore . |
| 3,213,465 | 10/1965 | Ludwikowski . |
| 3,536,083 | 10/1970 | Reynolds . |
| 3,710,395 | 1/1973 | Spano et al. . |
| 3,761,962 | 10/1973 | Myers . |
| 3,921,224 | 11/1975 | Ingram, III . |
| 4,185,327 | 1/1980 | Markve . |
| 4,408,356 | 10/1983 | Abrams . |
| 4,513,451 | 4/1985 | Brown . |
| 4,608,715 | 9/1986 | Miller et al. . |
| 4,722,099 | 2/1988 | Kratz . |
| 4,731,883 | 3/1988 | Foster . |

FOREIGN PATENT DOCUMENTS

| | | |
|---|---|---|
| 0 034 518 | 8/1981 | European Pat. Off. . |
| 1209851 | 6/1953 | France . |
| 1220511 | 5/1960 | France . |
| 35-4030 | 10/1960 | Japan . |
| 63-2419 | 1/1988 | Japan . |
| 2-61907 | 5/1990 | Japan . |
| 1671248 A1 | 8/1991 | U.S.S.R. . |
| 16900 | 10/1911 | United Kingdom . |

*Primary Examiner*—Gloria Hale
*Attorney, Agent, or Firm*—Lappin & Kusmer LLP

[57] ABSTRACT

A ventilated garment is provided having at least one substantially non-stretchable front panel and at least one rear panel, in which the front and rear panels have an opening therein, and in which the front panel includes a substantially non-stretchable, air permeable, vent panel, having a shape substantially corresponding to the front panel opening, affixed to the front panel along the periphery of the front panel opening. The front panel further includes a cover element having a shape substantially corresponding to the front panel opening. A first portion of the cover element periphery is affixed to the front panel substantially along a first portion of the periphery of the front panel opening. A first adjustable closure element adjustably couples a second portion of the cover element periphery to the front panel substantially along a second portion of the periphery of the front panel opening, and a second adjustable closure element adjustably couples a third portion of the cover element periphery to the front panel substantially along a third portion of the periphery of the front panel opening. The second and third portions of the cover element periphery extend between opposite ends of the first portion of the cover element periphery and the second and third portions of the periphery of the front panel opening extend between opposite ends of the first portion of the periphery of the front panel opening.

18 Claims, 7 Drawing Sheets

GARMENT WITH STRUCTURAL VENT

This application is a continuation of prior application U.S. application Ser. No. 08/349,269, now abandoned, filed on Dec. 5, 1994, which is a continuation-in-part of prior International Patent Application Ser. No. PCT/US94/04121, filed on April 14, 1994 entitled "GARMENT WITH STRUCTURAL VENT".

BACKGROUND OF THE INVENTION

When operating fast moving, relatively open vehicles such as motorcycles, bicycles, and some aircraft, the use of protective apparel is important. However, to be useful, protective apparel must be comfortable enough to wear. Many of the garments commonly used for such applications, such as leather suits and jackets, are unacceptably uncomfortable because they provide poor ventilation. Poor ventilation can be a serious problem during warm or moderate weather.

Wearing poorly ventilated protective apparel is uncomfortable on warm days because poor ventilation causes excessive heat buildup. As a result, the wearer may discard the apparel on warm days. Alternatively, the wearer may partially unfasten the front of the garment to provide some ventilation. However, wearing an unfastened garment can be hazardous when traveling at high speed. Air trapped by the opened garment causes billowing or ballooning of the garment and generates unstable forces on the wearer.

Some ventilation systems for protective garments are known in the art. U.S. Pat. No. 4,608,715 issued to Miller et al. teaches a vented garment having a linear closure element, e.g., a zipper provided on the garment, with an air permeable material extending in a rough "C" shape from the edges of the closure element. The vents are adjustably opened by an associated zipper. With the vents opened, the garment would distort in use, providing a poor fit to the wearer.

U.S. Pat. No. 4,513,451 issued to Brown teaches providing a garment with openings that are spanned by a stretchable mesh fabric. Variable closure elements adjustably cover the openings to permit selective control of the effective area of the opening, and thus also control the air flow through the opening. The Brown garment does provide effective ventilation, however, due to the stretchable nature of the mesh fabric, it provides a poor fit to the wearer.

It is therefore an object of the present invention to provide a protective garment with an improved ventilation system.

It is further an object of the present invention to provide a protective garment having an improved ventilation system and providing an improved and stable fit to the wearer.

It is also an object of the invention to provide a protective garment having an improved ventilation system that offers increased comfort.

It is a further object of the invention to provide a protective garment with an adjustable ventilation system that provides increased ventilation over the body of the wearer.

Other objects and advantages of the present invention will become apparent upon consideration of the appended drawings and description thereof.

SUMMARY OF THE INVENTION

In one aspect, the invention provides a ventilated garment having at least one substantially non-stretchable front panel and at least one rear panel, in which the front and rear panels each have an opening therein permitting air flow in through the front panel and out through the rear panel. The front panel includes a vent element which is a substantially non-stretchable, air permeable, sheet, and has a shape substantially corresponding to the front panel opening. The vent element is affixed to the front panel along the periphery of the front panel opening, thereby spanning that opening. The front panel further includes a cover element having a shape substantially corresponding to the front panel opening. A first portion of the periphery of the cover element is affixed to the front panel substantially along a first portion of the periphery of the front panel opening. A first adjustable closure element adjustably couples a second portion of the periphery of the cover element to the front panel substantially along a second portion of the periphery of the front panel opening, and a second adjustable closure element adjustably couples a third portion of the periphery of the cover element to the front panel substantially along a third portion of the periphery of the front panel opening. The second and third portions of the cover element periphery extend from opposite ends of the first portion of the cover element periphery and the second and third portions of the periphery of the front panel opening extend from opposite ends of the first portion of the periphery of the front panel opening.

In one aspect, the vent panel is provided in the form of perforated material.

In another aspect, the first and second adjustable closure elements are provided in the form of zippers.

In another aspect, a third adjustable closure element adjustably couples a fourth portion of the cover element to a fourth portion of the periphery of the front panel opening. In this aspect, the third closure element can be provided in the form of a hook and loop type fastener, such as a VELCRO™fastener.

In yet another aspect, the rear panel includes a rear closure element for adjustably closing the rear panel opening. In this aspect the rear closure element can be provided in the form of a zipper. In this aspect the rear panel may also include a substantially non-stretchable vent panel that is affixed to the rear panel substantially under the rear panel opening. In this aspect the rear panel may also include a non-permeable backing flap affixed beneath the zipper and extending over at least a portion of the vent panel.

In another aspect, the cover element does not have a shape corresponding to the front panel opening.

In yet another aspect, the invention provides a ventilated garment having at least one substantially non-stretchable front panel and at least one rear panel, in which the front panel and the rear panel each have an opening therein permitting air flow in the front panel and out the rear panel. The front panel includes a vent element which is a substantially non-stretchable, air permeable, sheet, having a shape substantially corresponding to the front panel opening. The vent element is affixed to the front panel along the periphery of the front panel opening, thereby spanning that opening. The front panel further includes a cover element. A first portion of the periphery of the cover element is affixed to the front panel along a first curve. A first adjustable closure element adjustably couples a second portion of the periphery of the cover element to the front panel along a second curve, and a second adjustable closure element adjustably couples a third portion of the periphery of the cover element to the front panel along a third curve. The second curve and the third curve extend substantially from opposite ends of the first curve and a fourth curve extends substantially between opposite ends of the second and the third curve distal from the first curve such that the first, second, third, and fourth curves form a periphery that substantially overlies the front panel opening.

BRIEF DESCRIPTION OF THE DRAWINGS

For a fuller understanding of the nature and the objects of the invention, reference should be made to the following detailed description and the accompanying drawings in which like reference numerals refer to like elements and in which.

DETAILED DESCRIPTION OF THE ILLUSTRATED EMBODIMENT

Figure 1:
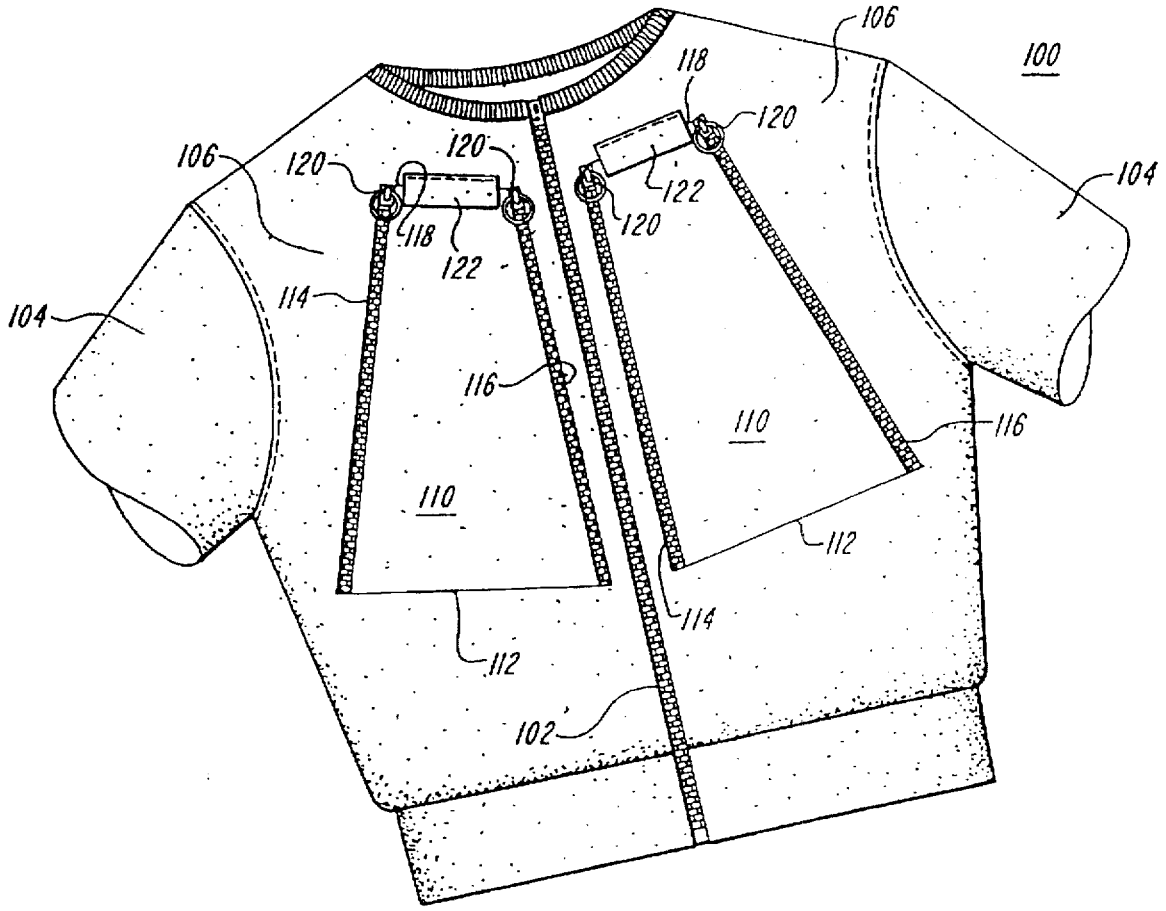
FIG. 1 shows a front view of a jacket according to the present invention.

FIG. 1 shows a front view of a jacket 100 according to the present invention. Jacket 100 is equipped with a central zipper 102, arms 104, and two front panels 106. Each front panel 106 contains an opening 108 (not shown in FIG. 1). Openings, 108 are bounded by edges 112, 114, 116, and 118 in the front panels 106. Cover panels 110 are affixed to front panels 106 to adjustably overlie portions of the openings 108. As shown in FIG. 1, the cover panels 110 fully overlie the openings 108 in both panels 106. As described below, the cover elements 110 may be adjusted to fully or partially expose openings 108.

As shown in FIG. 1, the lower portion of cover panel 110 is affixed to front panel 106 along edge 112 at the lower end of opening 108. In the preferred embodiment, cover panel 110 is stitched or otherwise permanently affixed to front panel 106 along edge 112. In other embodiments cover panel 110 may be otherwise fastened to front panel 106 along edge 112 or alternatively, cover panel 110 may be formed from the same piece of material that forms front panel 106.

In the preferred embodiment, cover panel 110 is selectively and adjustably coupled to front panel 106 along edges 114, 116, 118. Zippers 120, or other adjustable couplers such as snaps or buttons, adjustably couple cover panel 110 to front panel 106 along edges 114, 116. Flap 122, extending from front panel 106, adjustably couples cover panel 110 to front panel 106 along edge 118. In the preferred embodiment, flap 122 couples cover panel 110 to front panel 106 by use of a hook and loop type fastener, such as a VELCRO™fastener. In alternative embodiments, flap 122 couples cover panel 110 by use of buttons, snaps, or other fasteners.

FIG. 1 shows the cover panels 110 completely covering the openings 108. In this configuration relatively little ventilation is provided through openings 108. The jacket is worn in this configuration during cold or bad weather days.

Figure 2:
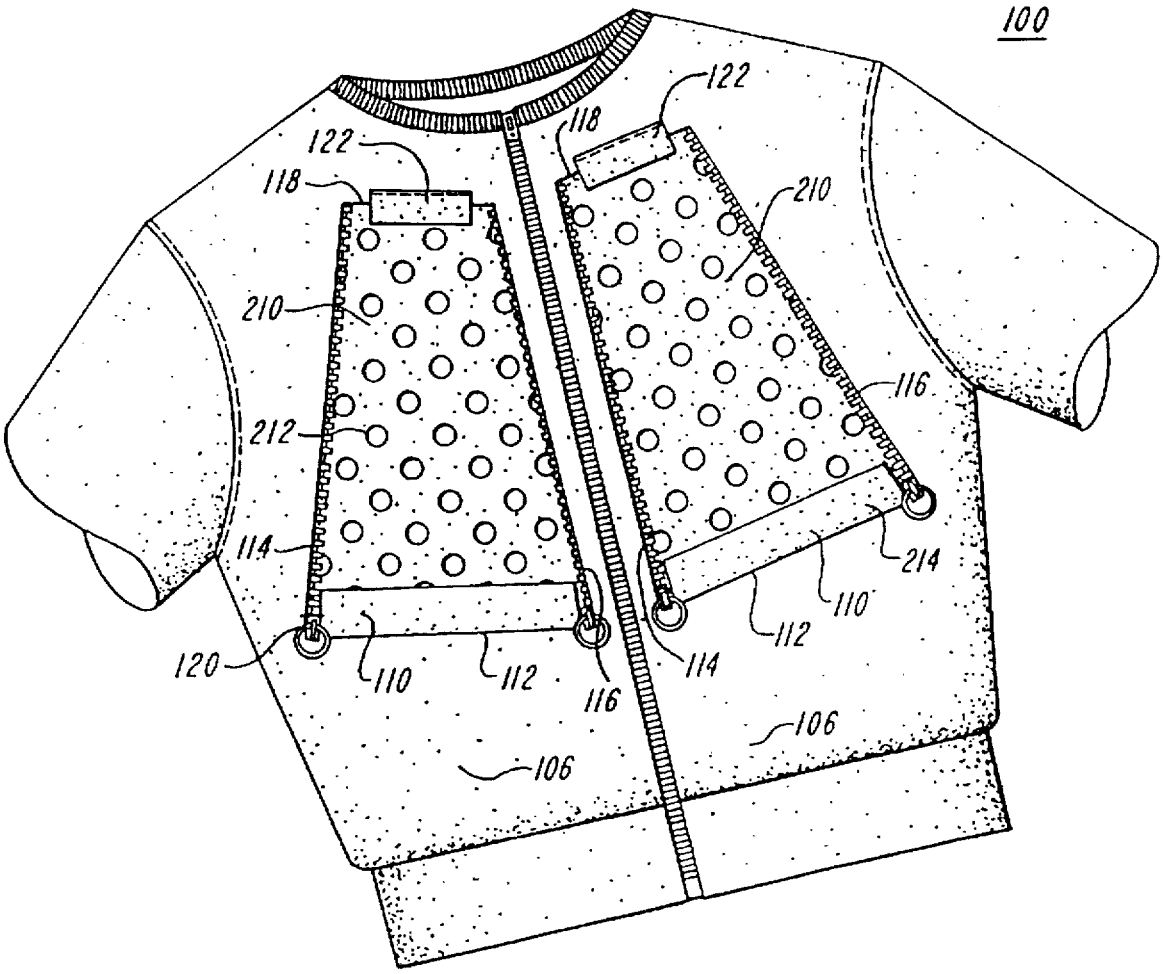
FIG. 2 shows a front view of the jacket of FIG. 1 in which the cover elements are opened.

When ventilation is desired, cover panels 110 can be fully opened to expose ventilation elements 210 shown in FIG. 2. Ventilation elements 210 are fabricated of a relatively non-stretchable, air permeable, sheet material, and preferably provide a resistance to stretching forces similar to that which is provided by front panel 106 when the zippers 120 are fully closed. In the preferred embodiment, front panels 106 are constructed of leather or vinyl, and ventilation elements 210 are constructed of perforated leather or vinyl. Other non-permeable materials may be used as well. Perforations 212 provide an air flow path through the vent elements 210.

In FIG. 2, cover panels 110 are shown in a maximally open position. In this configuration, zippers 120 have been maximally opened and the cover panels 110 have been folded into a retracted position. Cover panel 110 may be retracted simply by rolling the fabric of the panel upon itself, or alternatively, the folded panel may be tucked into a specially provided lower pocket 214. As those skilled in the art will readily appreciate, a lesser amount of ventilation can be provided by only partially opening cover panels 110, or by opening only one of the zippers 120 for each panel.

Due to the non-stretchable nature of vent elements 210, a garment according to the invention will retain its shape and provide an improved fit to the wearer, even when cover panels 110 are maximally open as shown in FIG. 2. Such a shape retaining adjustably ventilated garment has been heretofore unknown in the art.

Figure 3:
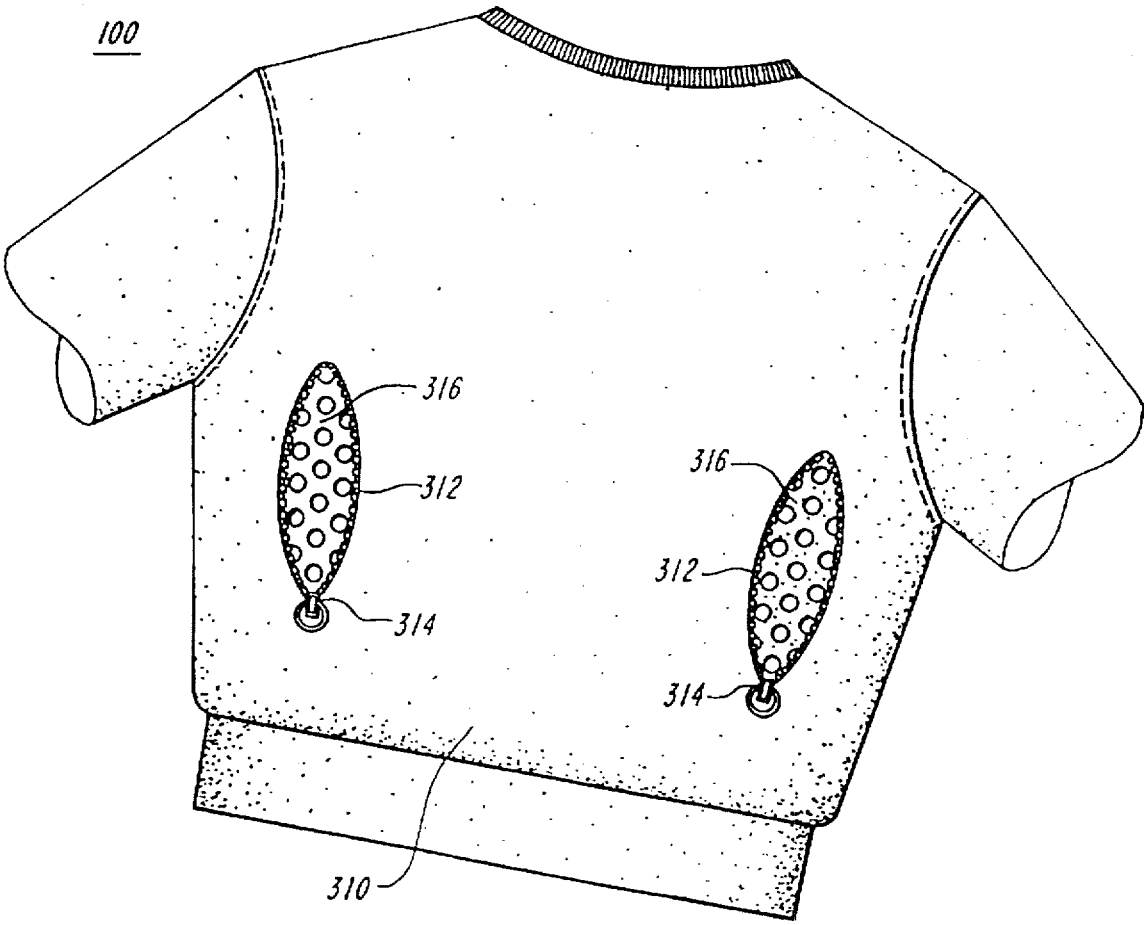
FIG. 3 shows a rear view of the jacket of FIG. 1.

FIG. 3 shows a rear view of jacket 100. In the preferred embodiment, jacket 100 contains a rear panel 310 which contains two openings 312. Openings 312 can be adjustably opened or closed by zippers 314. FIG. 3 shows the zippers 314 in the maximally opened position which exposes vent elements 316, which underlie the zippers 314. In some embodiments, vent elements 316 may be omitted. Preferably, vent elements 316 are constructed of a perforated leather or vinyl similar to that used for front vent elements 210, or may be constructed of other perforated non-permeable materials or from air permeable materials, such as nylon mesh.

The ventilation elements 210 when combined with vents 316 in the rear panels 310 of garment 100 establish an air flow through path permitting influx through vent elements 210 and outflux through vent established by openings 312. Thus opening front vent panels 210 and rear vent openings 312 allows air to pass through jacket 100 and around the body of the wearer (not shown), thus providing ventilation and preventing excessive heat buildup.

The garment 100 includes one or more peripheral closure elements illustrated in FIGS. 1–5 as a collar 105 and a waistband 107. These closure elements join the front panels 106 to the rear panel 310 and are adapted for cinched closure about respective portions of the wearer's body, thus defining, with the front and rear panels of the garment, a volume of air inside the garment which surrounds the wearer. As air enters the garment 100 through the front vent elements 210, it passes over and around the wearer's body and exits the garment through rear vents 312. Undesirable billowing of the garment is avoided, even when the garment is closed about the wearer, when the vents in both the front and the rear panels are open.

Figure 4A:
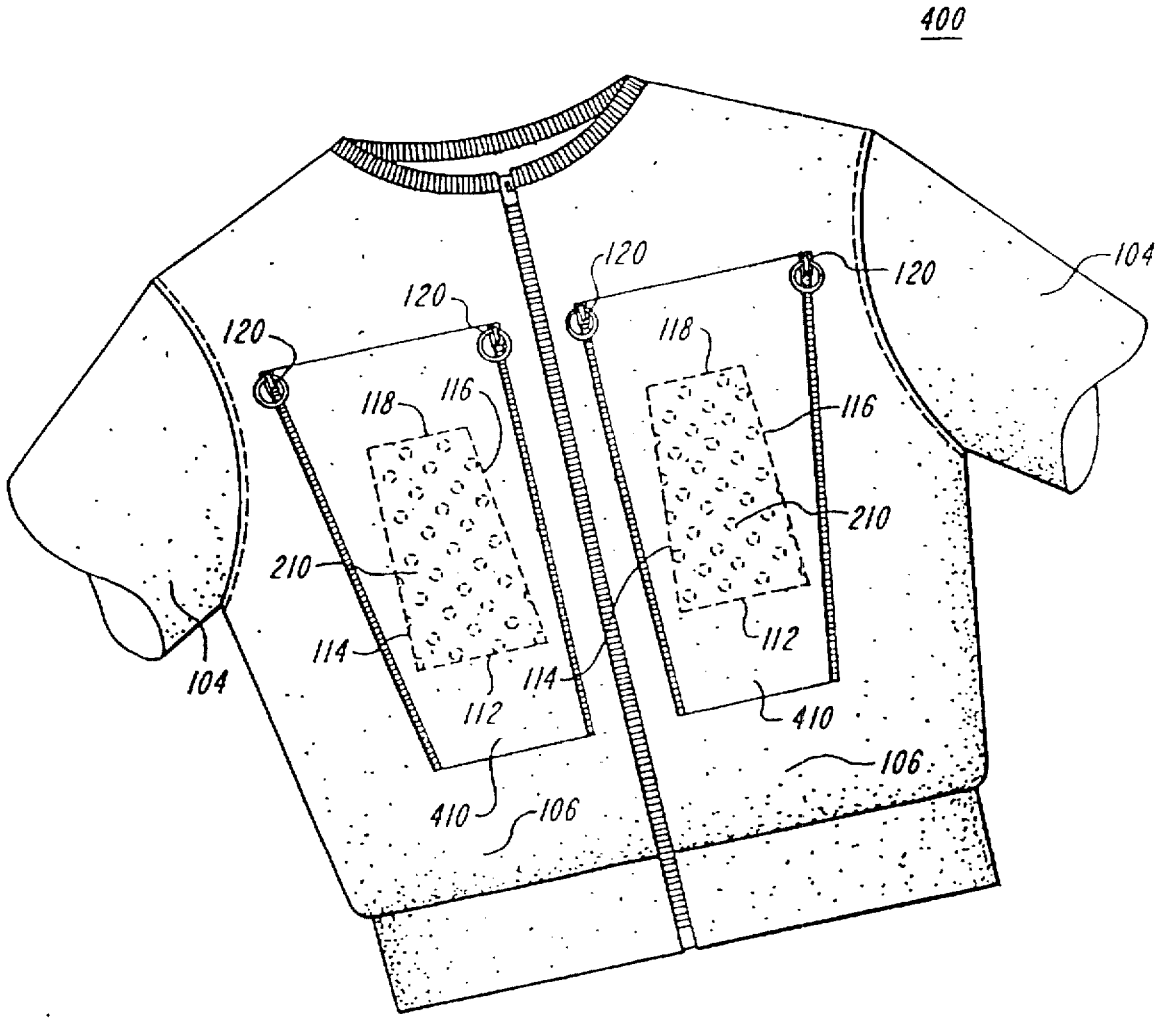
FIG. 4 shows a front view of a jacket according to another embodiment of the present invention.
FIG. 4B shows a front view according to still another embodiment of the present invention.

FIG. 4A shows a front view of another embodiment of a garment 400 according to the invention. The garment 400 is generally similar to the garment 100 shown in FIGS. 1 and 2, and corresponding elements are identified with the same reference designations in FIGS. 1,2 and 4. The primary difference is that in FIG. 4, cover panels 410 are larger and are not shaped similarly to vent elements 210 (shown in phantom, and underlying cover panels 410). As those skilled in the art will readily appreciate, the cover panels 410 can be formed in a variety of shapes not necessarily corresponding to the shape of the vent elements. Cover panels 410 as shown in FIG. 4A are maximally closed and thereby minimize the air flow through vent elements 210. Vent panels 210 may be exposed, thereby increasing the air flow therethrough, by opening cover panels 410 by means of zippers 120.

Figure 4B:
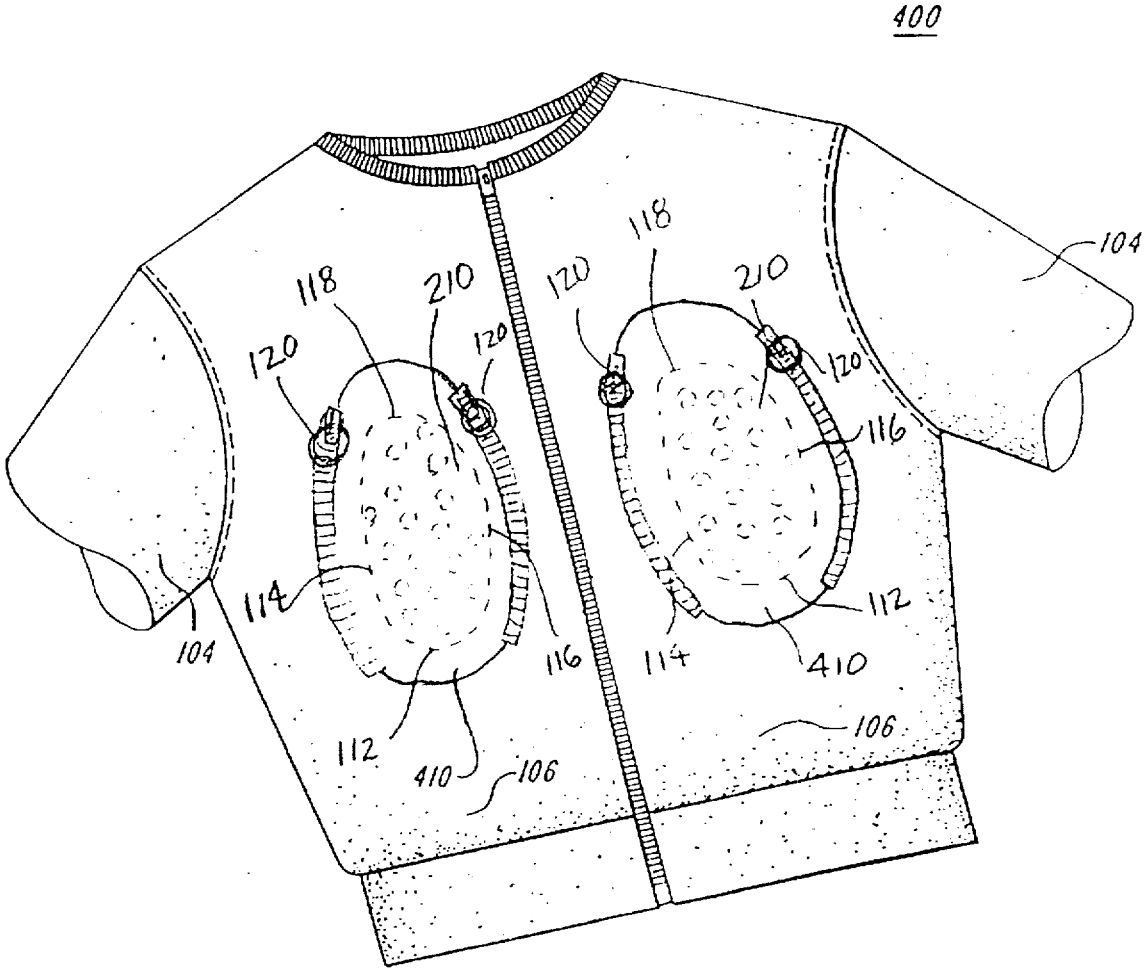

FIG. 4B illustrates an embodiment in which the vent panels 210 and cover elements 410 define a curved periphery. Those skilled in the art will appreciate that the vent panels 210 and cover elements 410 can be of any shape and size which will allow for adjustable venting of the garment, as well as aesthetic appeal and simplicity of design.

It is often desirable to provide protection against air leakage into the interior of the garment 100 when the wearer is traveling at high speeds with the cover panels 110 closed, i.e., fully extended over the vent panels 210.

Figure 5:
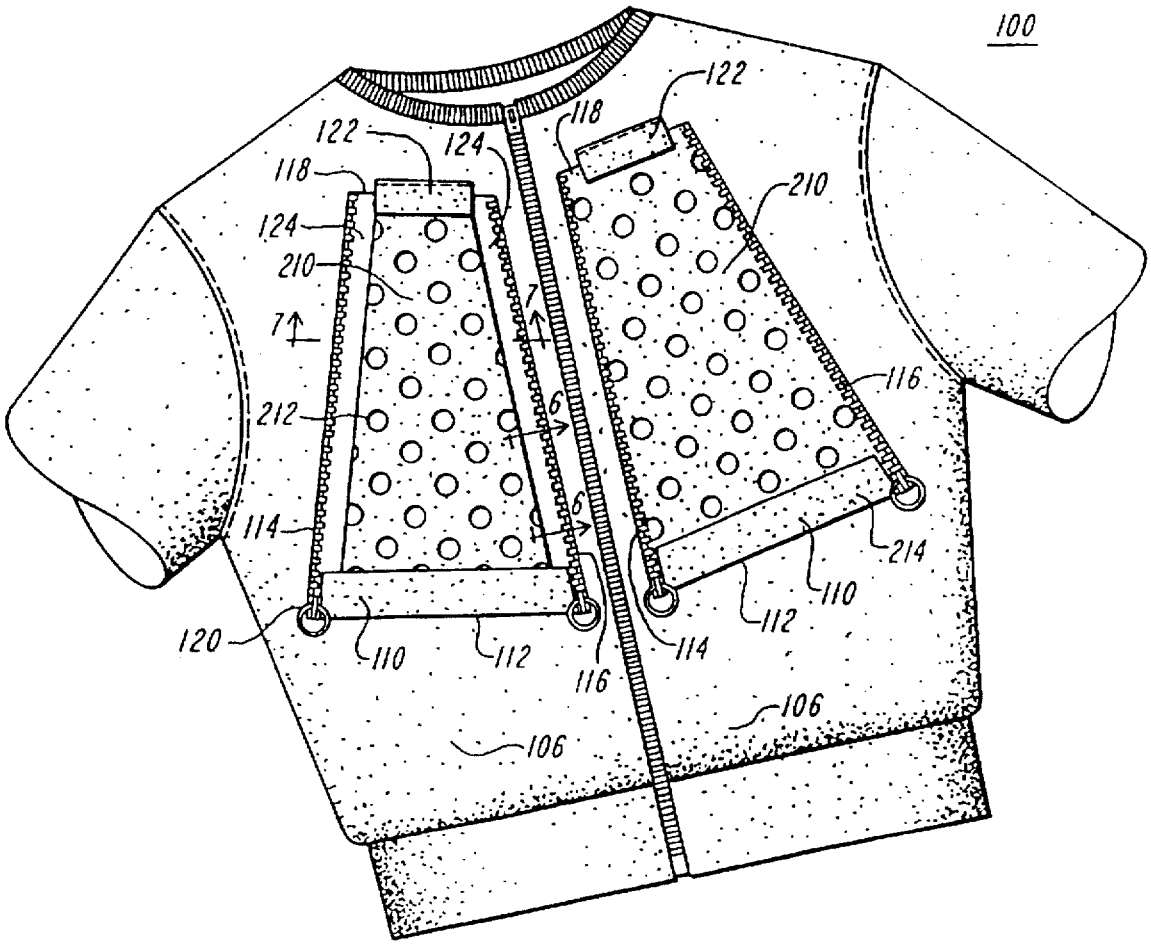
FIG. 5 shows a front view of a jacket according to yet another embodiment of the present invention.
Figure 6:
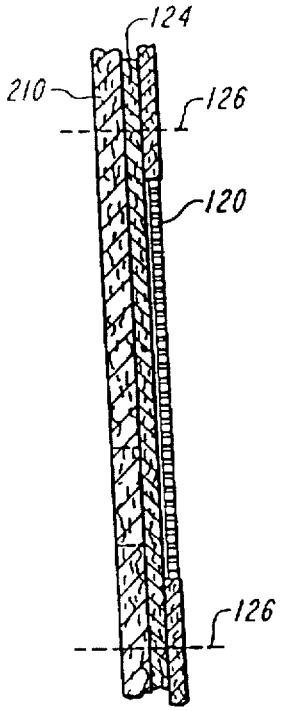
FIG. 6 shows a side sectional view of the front panel and closure element and backing flap of the jacket of FIG. 5.
Figure 7:
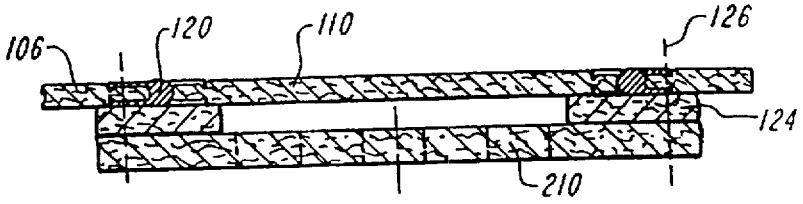
FIG. 7 shows a top sectional view of the front panel cover element, backing flap and closure element of the jacket of FIG. 5.

FIG. 5 shows a front view of a garment 100 according to another embodiment of the invention. In this embodiment, zippers 120 overlie a non-permeable backing flap 124 (shown in the right front panel 106 in FIG. 5). The backing flap 124 lies beneath the zipper 120 and over a portion of the ventilation element 210, as shown in detail in FIGS. 6 and 7. The ventilation element 210, the backing flap 124 and the zipper 120 can all be stitched together with stitching 126 to provide an air-impervious backing to zipper 120 when the zipper 120 is closed and cover element 110 is fully extended over the ventilation element 210, as shown in FIG. 1. The backing flap 124 is preferably made of a non-permeable material, such as vinyl, leather or plastic, which resists penetration by air and moisture.

The backing flap 124 can also be used behind other closure elements, such as buttons or snaps, to improve the garment's resistance to air and moisture leakage when the ventilation elements 210 are fully covered by the cover elements 110.

While the above embodiment of the invention each include two front panels, each having a vent, and a rear panel, having a vent, it will be understood that various configurations with differing numbers of panels and vents may be used in keeping with the invention. Also, the cover element as shown is preferably constructed of a non-strechable material, but in other configurations, it may be strechable since the vent elements provide the structural stability for the garment.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

Having described the invention, what is claimed as new and secured by Letters Patent is:

1. A ventilated garment having at least one substantially non-stretchable front panel, at least one rear panel, and one or more peripheral closure elements joining said front and rear panels and being adapted for closure about a portion of a wearer's body, said front panel and said rear panel each having an opening therein defined by a periphery, said front panel including a substantially non-stretchable, air permeable, vent panel having a shape substantially corresponding to said front panel opening and affixed to said front panel along said front panel opening periphery, said front panel further including a cover element defined by a periphery and having a shape substantially corresponding to said front panel opening, wherein a first portion of said cover element periphery is affixed to said front panel substantially along a first portion of said front panel opening periphery, and a first adjustable closure element adjustably coupling a second portion of said cover element periphery to said front panel substantially along a second portion of said front panel opening periphery, and a second adjustable closure element adjustably coupling a third portion of said cover element periphery to said front panel substantially along a third portion of said front panel opening periphery, wherein said second portion and said third portion of said cover element periphery extend substantially from opposite ends of said first portion of said cover element periphery and wherein said second portion and said third portion of said front panel opening periphery extend substantially from opposite ends of said first portion of said front panel opening periphery.

2. A ventilated garment according to claim 1 wherein said front panel is made from a material selected from the group consisting of leather and vinyl.

3. A ventilated garment according to claim 1 wherein said cover element is made from a material selected from the group consisting of leather and vinyl.

4. A ventilated garment according to claim 1 wherein said vent panel comprises a perforated material.

5. A ventilated garment according to claim 1 wherein said first and second closure elements comprise zippers.

6. A ventilated garment according to claim 5 further comprising a non-permeable backing flap affixed between said zipper and said front vent panel and extending transversely over at least a portion of said front vent panel.

7. A ventilated garment according to claim 1 further including a third closure element for adjustably coupling a fourth portion of said cover element periphery to said front panel substantially along a fourth portion of said front panel opening periphery, wherein said fourth portion of said cover element periphery extends substantially between said second and said third portion of said cover element periphery and wherein said fourth portion of said front panel opening periphery extends substantially between said second portion and said third portion of said front panel opening periphery.

8. A ventilated garment according to claim 7 wherein said third closure element comprises a hook and loop type fastener.

9. A ventilated garment according to claim 7 wherein said first, second, third and fourth portions of said front panel opening periphery substantially comprise the entirety of said periphery.

10. A ventilated garment according to claim 1 wherein said rear panel comprises a substantially non-stretchable vent panel affixed to said rear panel substantially along said rear panel opening periphery.

11. A ventilated garment according to claim 10 wherein said rear panel further includes a rear closure element for adjustably closing said rear panel opening.

12. A ventilated garment according to claim 11 wherein said rear closure element comprises a zipper.

13. (Amended) A ventilated garment according to claim 11 further comprising a non-permeable backing flap affixed between said zipper and said vent panel and extending transversely over at least a portion of said vent panel.

14. A ventilated garment having at least one substantially non-stretchable front panel and at least one rear panel, said front panel and said rear panel each having an opening therein defined by a periphery, said front panel including a substantially non-stretchable, air permeable, vent panel having a shape substantially corresponding to said front panel opening and affixed to said front panel along said front panel opening periphery, said front panel further including a cover element defined by a periphery, wherein a first portion of said cover element periphery is affixed to said front panel along a first curve, and a first adjustable closure element adjustably coupling a second portion of said cover element periphery to said front panel along a second curve, and a second adjustable closure element adjustably coupling a third portion of said cover element periphery to said front panel along a third curve, wherein said second curve and said third curve extend substantially from opposite ends of said first curve and a fourth curve extends substantially between opposite ends of said second and said third curve distal from said first curve and wherein said first, second, third, and fourth curves form a periphery substantially overlying said front panel opening.

15. A ventilated garment according to claim 1 wherein said cover element is formed from said front panel.

16. A ventilated garment according to claim 15 wherein said first portion of said cover element is permanently affixed to said front panel.

17. A ventilated garment according to claim 1 wherein said garment is a jacket and said peripheral closure elements comprise a collar and a waistband.

18. A ventilated garment having at least one substantially non-stretchable front panel and at least one rear panel, said front panel and said rear panel each having an opening therein defined by a periphery, said front panel including a vent element defined by a substantially non-stretchable, air permeable sheet, said vent element having a shape substantially corresponding to said front panel opening and affixed to said front panel along said front panel opening periphery, said front panel further including a cover element defined by a periphery and having a shape substantially corresponding to said front panel opening, wherein a first portion of said cover element periphery is affixed to said front panel substantially along a first portion of said front panel opening periphery, and a first adjustable closure element adjustably coupling a second portion of said cover element periphery to said front panel substantially along a second portion of said front panel opening periphery, and a second adjustable closure element adjustably coupling a third portion of said cover element periphery to said front panel substantially along a third portion of said front panel opening periphery, wherein said second portion and said third portion of said cover element periphery extend substantially from opposite ends of said first portion of said cover element periphery and wherein said second portion and said third portion of said front panel opening periphery extend substantially from opposite ends of said first portion of said front panel opening periphery.

* * * * *